US006653270B2

(12) United States Patent
LaBeque

(10) Patent No.: US 6,653,270 B2
(45) Date of Patent: Nov. 25, 2003

(54) STABILIZED BLEACH COMPOSITIONS

(75) Inventor: Regine LaBeque, Brussels (BE)

(73) Assignee: Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/142,070

(22) Filed: May 9, 2002

(65) Prior Publication Data

US 2002/0193271 A1 Dec. 19, 2002

Related U.S. Application Data

(63) Continuation of application No. 09/914,528, filed as application No. PCT/US00/05291 on Feb. 29, 2000, now abandoned.

(60) Provisional application No. 60/122,492, filed on Mar. 2, 1999, now abandoned.

(51) Int. Cl.[7] ..... C11D 1/00; C11D 3/20; C11D 3/26; C11D 3/395

(52) U.S. Cl. ..... 510/311; 510/302; 510/303; 510/312; 510/220; 510/224; 510/372; 510/376; 8/111; 8/137; 252/186.33

(58) Field of Search ..... 510/302, 303, 510/304, 311, 312, 313, 314, 220, 221, 224, 372, 376; 8/111, 137; 252/186.33

(56) References Cited

U.S. PATENT DOCUMENTS

| | | | | | |
|---|---|---|---|---|---|
| 4,888,032 | A | * | 12/1989 | Busch | 55/38 |
| 5,244,594 | A | * | 9/1993 | Favre et al. | 252/186.33 |
| 5,254,287 | A | * | 10/1993 | Deleeuw et al. | 252/186.27 |
| 5,366,510 | A | | 11/1994 | Wasinger et al. | |
| 5,641,739 | A | * | 6/1997 | Kott et al. | 510/372 |
| 6,218,351 | B1 | * | 4/2001 | Busch et al. | 510/311 |
| 6,225,464 | B1 | | 5/2001 | Hiler, II et al. | |
| 6,306,812 | B1 | * | 10/2001 | Perkins et al. | 510/310 |
| 6,387,862 | B2 | | 5/2002 | Busch et al. | |
| 6,399,557 | B2 | * | 6/2002 | Perkins et al. | 510/310 |
| 6,444,808 | B2 | | 9/2002 | Hiler, II et al. | |

FOREIGN PATENT DOCUMENTS

| | | | |
|---|---|---|---|
| EP | 0 743 356 A1 | | 11/1996 |
| WO | WO 98/39098 A1 | | 9/1998 |
| WO | WO98/39098 | * | 9/1998 |
| WO | WO 98/39405 A1 | | 9/1998 |
| WO | WO98/39406 | * | 9/1998 |
| WO | WO 99/00473 A1 | | 1/1999 |

OTHER PUBLICATIONS

U.S. patent application Ser. No. 10/228,854, Busch et al., filed Aug. 27, 2002.
U.S. patent application Ser. No. 10/228,853, Busch et al., filed Aug. 27. 2002.
U.S. patent application Ser. No. 10/093,115, Perkins et al., filed Mar. 7, 2002.
U.S. patent application Ser. No. 10/142,085, Hiler et al., filed May 9, 2002.
U.S. patent application Ser. No. 10/142,041, Burns et al., filed May 9, 2002.

* cited by examiner

*Primary Examiner*—Gregory Delcotto
(74) *Attorney, Agent, or Firm*—James F. McBride; Kim W. Zerby; Steve W. Miller

(57) ABSTRACT

The present invention relates to bleaching, pre-soak, pre-treatment, and laundry detergent compositions comprising:

A) a catalytically effective amount of a transition-metal bleach catalyst which is a complex of a transition-metal and a cross-bridged macropolycyclic ligand, for example, 5,12-dimethyl-1,5,8,12-tetraazabicyclo [6.6.2] hexadecane manganese (II) chloride, having the formula:

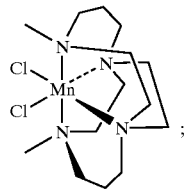

;

B) an effective amount of a stabilizing agent, said agent selected from
i) one or more anti-oxidants;
ii) one or more reducing agents;
iii) and mixtures thereof; and C) the balance carriers and other adjunct ingredients; provided said composition is substantially free of any organic or inorganic peroxygen compounds.

35 Claims, No Drawings

STABILIZED BLEACH COMPOSITIONS

CROSS REFERENCE TO RELATED APPLICATIONS

This application is a continuation under 35 USC §120 to U.S. application Ser. No. 09/914,528, filed Aug. 29, 2001, now abandoned which is an entry into the U.S. National Stage under 35 U.S.C. §371 of PCT International Application Ser. No. PCT/US00/05291, filed Feb. 29, 2000 which claims priority under PCT Article 8 and 35 U.S.C. § 119(e) to U.S. Provisional Application Ser. No. 60/122,492 filed Mar. 2, 1999, (now abandoned).

FIELD OF THE INVENTION

The present invention relates to stabilized bleaching and detergent compositions which comprise a catalytically effective amount of a transition-metal bleach catalyst which is a complex of a transition-metal and a cross-bridged macropolycyclic ligand and an anti-oxidant or reducing agent which serves to stabilize said catalyst. The present invention further relates to a method for bleaching/cleaning fabric with a catalytically effective amount of said stabilized transition-metal bleach catalyst wherein the method is performed substantially free of any organic or inorganic peroxygen compound or precursors to any organic or inorganic peroxygen compound.

BACKGROUND OF THE INVENTION

Bleaching of fabric is essentially exposing soiled or stained fabric to a chemical reaction the purpose of which is to eliminate the soil or stain. At one point in time, bleaching involved exposure of fabric to a solution of hypochlorite. Therefore, fabric which was colored or dyed via sensitive pigments were excluded from treatment with bleach. To the benefit of the consumer, formulators developed various forms of bleach inter alia peroxygen bleaching systems which typically comprise a source of hydrogen peroxide and a bleach activator. This combination of source of hydrogen peroxide and activator plays a dominating role in effective, safe bleaching compositions. An effective example of this peroxygen bleaching system employs perborate (peroxygen source) and nonanoyloxybenzene sulfonate (activator).

In order to boost the performance of bleaching agents and to develop bleaching systems which are safe to any type of dyed or colored fabric inter alia silk, polyester blends, cotton, nylon, formulators have continued to develop peroxygen bleaching systems, as well as new methods of forming activated oxygen.

However, there still remains a need in the art for a stable bleaching system which will effectively bleach fabric without the need for reactive chemicals such as peroxides, sources of peroxide, and/or mixtures thereof. Said stable bleaching system will comprise a transition-metal catalyst which does not loose its effectiveness due to the instability of the catalyst to oxidation and/or reduction post formulation.

SUMMARY OF THE INVENTION

The present invention meets the aforementioned needs in that it has been surprisingly discovered that bleaching systems comprising a transition-metal catalyst which are capable of bleaching soils and stains in the absence of a source of hydrogen peroxide or other peroxygen bleaching agent can be successfully stabilized against the unwanted degradation of the transition-metal catalyst. In other words, it has been surprisingly discovered that the addition of an effective amount of an anti-oxidant and/or free radical scavenger or an reducing agent can stabilize a nil hydrogen peroxide bleaching system.

A first aspect of the present invention relates to stabilized bleaching compositions comprising:

A) a catalytically effective amount of a transition-metal bleach catalyst which is a complex of a transition-metal and a cross-bridged macropolycyclic ligand;

B) an effective amount of a stabilizing agent, said agent selected from
   i) one or more anti-oxidants;
   ii) one or more reducing agents;
   iii) and mixtures thereof; and C) the balance carriers and other adjunct ingredients;

provided said composition is substantially free of any organic or inorganic peroxygen compounds.

The present invention further relates to a method for cleaning and/or bleaching soils and stains on fabrics, said method comprising the step of contacting the fabric in need of cleaning and/or bleaching with an aqueous solution containing a composition which is substantially free of a peroxygen source and which comprises:

a) a catalytically effective amount of a transition-metal bleach catalyst which is a complex of a transition-metal and a cross-bridged macropolycyclic ligand;

b) an effective amount of a stabilizing agent, said agent selected from
   i) one or more anti-oxidants;
   ii) one or more reducing agents;
   iii) and mixtures thereof; and c) the balance carriers and other adjunct ingredients;

provided the concentration of said transition metal bleach catalyst in the aqueous solution is at least about 0.01 ppb and said composition is substantially free of any organic or inorganic peroxygen compounds.

The compositions and methods of the present invention are suitable for cleaning/bleaching any surface in need of stain removal. For example, hard surface cleaners and automatic dishwashing compositions can employ the bleach catalysts of the present invention in applications which are substantially free of any organic or inorganic peroxygen compounds.

These and other objects, features, and advantages will become apparent to those of ordinary skill in the art from a reading of the following detailed description and the appended claims.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to the surprising discovery that transition-metal catalysts which are capable of bleaching of soils and stains in the absence of an added peroxygen bleach can be suitably stabilized by the addition of one or more stabilizing agents. The stabilizing agents suitable for use in the present invention are present at varying level depending upon the formulation inter alia liquid, solid, gel, and the concentration of the transition-metal present.

Absence of Peroxygen Sources

The compositions of the present invention, as well as the methods for cleaning and/or bleaching of fabric which utilize the compositions of the present invention are substantially free of any peroxygen source such as hydrogen peroxide, peroxyacid etc. The compositions of the present invention need only have an effective amount of the herein below described catalyst present for effective bleaching. For the purposes of the present invention the term "substantially free" is defined as "the formulator does not include in the composition any peroxygen compound or source of peroxygen at a level required for either effective bleaching without a transition metal catalyst, or which would provide an increase in effectiveness of bleaching in the presence of a transition metal catalyst as defined herein." Therefore, as will be further described herein below, effective bleaching of stains can be accomplished by simply adding an aqueous or non-aqueous solution of a catalyst as described herein to fabric which is stained, preferably the fabric is in an aqueous solution when contacted with the catalyst. However, it is recognized that because of factors outside the control of the formulator inter alia source of product raw materials, unwanted decomposition of one or more ingredients, that a source of peroxygen may be introduced and/or formed unknowingly in the product. The compositions of the present invention do not require any peroxygen source, but the presence of any minor amounts will not effect the performance of the bleaching compositions described herein.

Formulators may typically include a small amount of a source of hydrogen peroxide into compositions for the purposes of stabilizing enzymes, for example, a minor amount of perborate may be added. However, this amount of perborate is typically so minor that it has no effect on the bleaching capacity of the compositions of the present invention. In cases where the formulator has added a minor amount of an oxidant, or other source of peroxide for the purposes of stabilizing an adjunct ingredient, for the purposes of the present invention, those compositions are still defined as "substantially free" of a source of peroxygen as defined herein above if they do not provide additional bleaching activity on stains under typical use conditions. For example, a "substantially free" composition can include an amount of peroxygen source provided the degree to which the catalyst is effective is substantially the same as if the source of peroxygen were absent. For the purposes of the present invention, any composition which comprises less than 0.1%, preferably less than 0.01% of a primary oxidant, such as a pre-formed peracid or a source of hydrogen peroxide is considered "substantially free" as further defined herein above. Additionally, any laundry liquor, laundry wash water, pre-soak bath, or other fabric or surface cleaning solution, wherein the present catalysts are used and which comprises less than 0.001% by weight of a source of peroxygen, pre-formed or otherwise formed in situ, is defined herein as "substantially free" as defined herein above. Stated otherwise, if the catalysts of the present invention are used to bleach stains on fabric, or otherwise clean/bleach a hard surface or dishware, and the solution containing the catalyst has a concentration of a source of peroxygen less than 0.001%, that solution is defined herein as "substantially free" of a source of peroxygen.

Bleach Catalyst

The compositions of the present invention comprise an effective amount of a bleach catalyst. The term "an effective amount" is defined as "an amount of the transition-metal bleach catalyst present in the present invention compositions, or during use according to the present invention methods, that is sufficient, under whatever comparative or use conditions are employed, to result in at least partial oxidation of the material sought to be oxidized by the composition or method." Typically the material to be oxidized is an unwanted substance inter alia food and beverage stains, greasy/oily stains, body oils on fabric, however, this is not the limitation to which the invention is applicable. Oxidation in the absence of a source of peroxygen has wide applicability and the present invention is not limited solely to bleaching and/or cleaning of fabric. For example, automatic dishwashing compositions are an embodiment of the present invention wherein bleaching of a stain with a composition and/or with a solution which is "substantially free" of a source of peroxygen is a part of the present invention. The same is equally true for hard surface cleaning compositions and solutions which comprise hard surface cleaning compositions which are "substantially free" of a source of peroxygen.

Preferably the compositions of the present invention comprise from about 1 ppb (0.0000001%), more preferably from about 100 ppb (0.00001%), yet more preferably from about 500 ppb (0.00005%), still more preferably from about 1 ppm (0.0001%) to about 99.9%, more preferably to about 50%, yet more preferably to about 5%, still more preferably to about 500 ppm (0.05%) by weight of the composition, of a transition-metal bleach catalyst as described herein below.

In the broadest view, the transition-metal bleach catalyst of the present invention comprises:

i) a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), preferably Mn(II), Mn(III), Mn(IV), Fe(II), Fe(III), FC(IV), Cr(II), Cr(III), Cr(IV), Cr(V), Cr(VI), and mixtures thereof; and ii) a cross-bridged macropolycyclic ligand being coordinated by four or five donor atoms to the same transition metal, said ligand comprising:

a) an organic macrocycle Ting containing four or more donor atoms (preferably at least 3, more preferably at least 4, of these donor atoms are N) separated from each other by covalent linkages of 2 or 3 non-donor atoms, two to five (preferably three to four, more preferably four) of these donor atoms being coordinated to the same transition metal atom in the complex;

b) a cross-bridged chain which covalently connects at least 2 non-adjacent donor atoms of the organic macrocycle ring, said covalently connected non-adjacent donor atoms being bridgehead donor atoms which are coordinated to the same transition metal in the complex, and wherein said cross-bridged chain comprises from 2 to about 10 atoms (preferably the cross-bridged chain is selected from 2, 3 or 4 non-donor atoms, and 4–6 non-donor atoms with a further donor atom);

c) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl.

The preferred cross-bridged macropolycyclic ligands are is selected from the group consisting of:

a) a cross-bridged macropolycyclic ligand of formula (I) having denticity of 4 or 5:

(I)

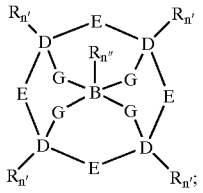

b) a cross-bridged macropolycyclic ligand of formula (II) having denticity of 5 or 6:

(II)

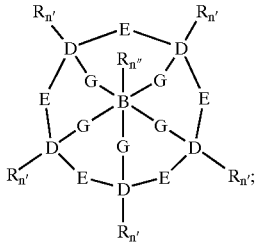

c) the cross-bridged macropolycyclic ligand of formula (III) having denticity of 6 or 7:

(III)

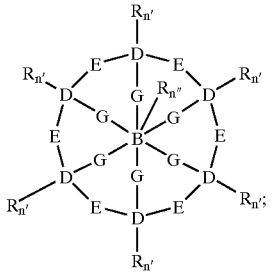

wherein each E unit represents the moiety having the formula:

$$(CR_n)_a—X—(CR_n)_a'$$

wherein X is selected from the group consisting of oxygen, sulfur, —NR—, phosphorous, or X represents a covalent bond wherein E has the formula:

$$(CR_n)_a—(CR_n)_a'$$

for each F units the sum of a+a' is independently selected from 1 to 5; each G unit is a moiety $(CR_n)_b$; each R unit is independently selected from H, alkyl, alkenyl, alkynyl, aryl, alkylaryl, and heteroaryl, or two or more R units are covalently bonded to form an aromatic, heteroaromatic, cycloalkyl, or heterocycloalkyl ring; each D unit is a donor atom independently selected from the group consisting of nitrogen, oxygen, sulfur, and phosphorous, and at least two atoms which comprise D units are bridgehead donor atoms coordinated to the transition metal; B units are a carbon atom, a D unit, or a cycloalkyl or heterocyclic ring; each n is an integer independently selected from 1 and 2, completing the valence of the carbon atoms to which the R units are covalently bonded; each n' is an integer independently selected from 0 and 1, completing the valence of the D donor atoms to which the R moieties are covalently bonded; each n" is an integer independently selected from 0, 1, and 2 completing the valence of the B atoms to which the R moieties are covalently bonded; each a and a' is an integer independently selected from 0 to 5, wherein the sum of all a+a' values in the ligand of formula (I) is within the range of from about 8 to about 12; the sum of all a+a' values in the ligand of formula (II) is within the range of from about 10 to about 15; and the sum of all a+a' values in the ligand of formula (III) is within the range of from about 12 to about 18; each b is an integer independently selected from 0 to 9, or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all b indices is within the range of from about 2 to about 5.

A further description of the bleach catalysts of the present invention can be found in WO 98/39406 A1, published Sep. 11, 1998, WO 98/39098 A1, published Sep. 11, 1998, and WO 98/39335 A1, published Sep. 11, 1998, all of which are included herein by reference.

The nomenclature used throughout this patent to describe the transition-metal bleach catalysts is the same nomenclature style used in the above-identified references. However, the chemical names of one or more of the herein described ligands may vary from the chemical name assigned under the rules of the International Union of Pure and Applied Chemistry (IUPAC). For example, a preferred ligand for the purposes of the present invention, 5,12-dimethyl-1,5,8,12-tetraaza-bicyclo[6.6.2]hexadecane, has the IUPAC name 4,11-dimethyl-1,4,8,11-tetraaza-bicyclo[6.6.2]hexadecane.

Transition-metal bleach catalysts useful in the invention compositions can in general include known compounds where they conform with the invention definition, as well as, more preferably, any of a large number of novel compounds expressly designed for the present laundry or cleaning uses. Non-limiting examples of suitable catalysts according to the present invention include:

Dichloro-5,12-dimethyl-1,5,8,12-tetraazabicyclo[6.6.2] hexadecane Manganese(II)

Dichloro-4,10-dimethyl-1,4,7,10-tetraazabicyclo[5.5.2] tetradecane Manganese(II)

Diaquo-5,12-dimethyl-1,5,8,12-tetraazabicyclo[6.6.2] hexadecane Manganese(II)
Hexafluorophosphate Aquo-hydroxy-5,12-dimethyl-1,5,8,12-tetraazabicyclo [6.6.2]hexadecane Manganese(III)
Hexafluorophosphate Diaquo-4,10-dimethyl-1,4,7,10-tetraazabicyclo[5.5.2] tetradecane Manganese(II)
Hexafluorophosphate Diaquo-5,12-dimethyl-1,5,8,12-tetraazabicyclo[6.6.2] hexadecane Manganese(II)
Tetrafluoroborate Diaquo-4,10-dimethyl-1,4,7,10-tetraazabicyclo[5.5.2] tetradecane Manganese(II)
Tetrafluoroborate Dichloro-5,12-dimethyl-1,5,8,12-tetraazabicyclo[6.6.2] hexadecane Manganese(III)

Hexafluorophosphate

Dichloro-5,12-di-n-butyl-1,5,8,12-tetraaza-bicyclo[6.6.2] hexadecane Manganese(II)

Dichloro-5,12-dibenzyl-1,5,8,12-tetraazabicyclo[6.6.2] hexadecane Manganese(II)

Dichloro-5-n-butyl-12-methyl-1,5,8,12-tetraaza- bicyclo [6.6.2]hexadecane Manganese(II)

Dichloro-5-n-octyl-12-methyl-1,5,8,12-tetraaza- bicyclo [6.6.2]hexadecane Manganese(II)

Dichloro-5-n-butyl-12-methyl-1,5,8,12-tetraaza- bicyclo [6.6.2]hexadecane Manganese(II)

Dichloro-5,12-dimethyl-1,5,8,12-tetraazabicyclo[6.6.2] hexadecane Iron(MI)

Dichloro-4,10-dimethyl-1,4,7,10-tetraazabicyclo[5.5.2] tetradecane Iron(II)

Dichloro-5,12-dimethyl-1,5,8,12-tetraazabicyclo[6.6.2] hexadecane Copper(II)

Dichloro-4,10-dimethyl-1,4,7,10-tetraazabicyclo[5.5.2] tetradecane Copper(II)

Dichloro-5,12-dimethyl-1,5,8,12-tetraazabicyclo[6.6.2] hexadecane Cobalt(II)

Dichloro-4,10-dimethyl-1,4,7,10-tetraazabicyclo[5.5.2] tetradecane Cobalt(II)

Dichloro 5,12-dimethyl-4-phenyl-1,5,8,12tetraazabicyclo [6.6.2]hexadecane Manganese(II)

Dichloro-4,10-dimethyl-3-phenyl-1,4,7,10-tetraazabicyclo [5.5.2]tetradecane Manganese(II)

Dichloro-5,12-dimethyl-4,9-diphenyl-1,5,8,12-tetraazabicyclo[6.6.2]hexadecane Manganese(II)

Dichloro-4,10-dimethyl-3,8-diphenyl-1,4,7,10-tetraazabicyclo [5.5.2]tetradecane Manganese(II)

Dichloro-5,12-dimethyl-2,11-diphenyl-1,5,8,12-tetraazabicyclo[6.6.2]hexadecane Manganese(II)

Dichloro-4,10-dimethyl-4,9-diphenyl-1,4,7,10-tetraazabicyclo[5.5.2]tetradecane Manganese(II)

Dichloro-2,4,5,9,11,12-hexamethyl-1,5,8,12-tetraazabicyclo[6.6.2]hexadecane Manganese(II)

Dichloro-2,3,5,9,10,12-hexamethyl-1,5,8,12-tetraazabicyclo[6.6.2]hexadecane Manganese(II)

Dichloro-2,2,4,5,9,9,11,12-octamethyl-1,5,8,12-tetraazabicyclo[6.6.2]hexadecane Manganese(II)

Dichloro-2,2,4,5,9,11,11,12-octamethyl-1,5,8,12-tetraazabicyclo[6.6.2]hexadecane Manganese(II)

Dichloro-3,3,5,10,10,12-hexamethyl-1,5,8,12-tetraazabicyclo[6.6.2]hexadecane Manganese(II)

Dichloro-3,5,10,12-tetramethyl-1,5,8,12-tetraazabicyclo [6.6.2]hexadecane Manganese(II)

Dichloro-3-butyl-5,10,12-trimethyl-1,5,8,12-tetraazabicyclo[6.6.2]hexadecane Manganese(II)

Dichloro-1,5,8,12-tetraazabicyclo[6.6.2]hexadecane Manganese(II)

Dichloro-1,4,7,10-tetraazabicyclo[5.5.2]tetradecane Manganese(II)

Dichloro-1,5,8,12-tetraazabicyclo[6.6.2]hexadecane Iron (II)

Dichloro-1,4,7,10-tetraazabicyclo[5.5.2]tetradecane Iron(II)

Aquo-chloro-2-(2-hydroxyphenyl)-5,12-dimethy 1,5,8,12-tetraazabicyclo[6.6.2]hexadecane Manganese(II)

Aquo-chloro-10-(2-hydroxybenzyl)-4,10-dimethyl-1,4,7, 10-tetraazabicyclo[5.5.2]tetradecane Manganese(II)

Chloro-2-(2-hydroxybenzyl)-5-methyl,5,8,12-tetraazabicyclo[6.6.2]hexadecane Manganese(II)

Chloro-10-(2-hydroxybenzyl)-4-methyl-1,4,7,10-tetraazabicyclo[5.5.2]tetradecane Manganese(II)

Chloro-5-methyl-12-(2-picolyl)-1,5,8,12-tetraazabicyclo [6.6.2]hexadecane Manganese(II) Chloride Chloro-4-methyl-10-(2-picolyl)-1,4,7,10-tetraazabicyclo [5.5.2]tetradecane Manganese(II) Chloride Dichloro-5-(2-sulfato)dodecyl-12-methyl-1,5,8,12-tetraazabicyclo[6.6.2]hexadecane Manganese(III)

Aquo-Chloro-5-(2-sulfato)dodecyl-12-methyl-1,5,8,12-tetraazabicyclo[6.6.2]hexadecane Manganese(II)

Aquo-Chloro-5-(3-sulfonopropyl)-12-methyl-1,5,8,12-tetraazabicyclo[6.6.2]hexadecane Manganese(II)

Dichloro-5-(Trimethylammoniopropyl)dodecyl-1 2-methyl-1,5,8,12-tetraazabicyclo[6.6.2]hexadecane Manganese (III) Chloride Dichloro-5,12-dimethyl-1,4,7,10,13-pentaazabicyclo[8.5.2] heptadecane Manganese(II)

Dichloro-14,20-dimethyl-1,10,14,20-tetraazatriyclo[8.6.6] docosa-3(8),4,6-triene Manganese(II)

Dichloro-4,11-dimethyl-1,4,7,11-tetraazabicyclo[6.5.2] pentadecane Manganese(II)

Dichloro-5,12-dimethyl-1,5,8,12-tetraazabicyclo[7.6.2] heptadecane Manganese(II)

Dichloro-5,13-dimethyl-1,5,9,13-tetraazabicyclo[7.7.2] heptadecane Manganese(II)

Dichloro-3,10-bis(butylcarboxy)-5,12-dimethyl-1,5,8,12-tetraazabicyclo[6.6.2]hexadecane Manganese(II)

Diaquo-3,10-dicarboxy-5,12-dimethyl-1,5,8,12-tetraazabicyclo[6.6.2]hexadecane Manganese(II)

Chloro-20-methyl-1,9,20,24,25-pentaaza-tetracyclo [7.7.7.1$^{3,7}$.1$^{11,15}$.]pentacosa-3,5,7(24),11,13,15(25)-hexaene manganese(II) Hexafluorophosphate Trifluoromethanesulfono-20-methyl-1,9,20,24,25-pentaaza-tetracyclo[7.7.7.1$^{3,7}$.1$^{11,15}$.]pentacosa-3,5,7(24),11,13,15 (25)-hexaene Manganese(II) Trifluoromethanesulfonate Trifluoromethanesulfono-20-methyl-1,9,20,24,25-pentaaza-tetracyclo[7.7.7.1$^{3,7}$.1$^{11,15}$.]pentacosa-3,5,7(24),11,13,15 (25)-hexaene Iron(II) Trifluoromethanesulfonate Chloro-5,12,17-trimethyl-1,5,8,12,17-pentaazabicyclo [6.6.5]nonadecane Manganese(II) Hexafluorophosphate Chloro-4,10,15-trimethyl-1,4,7,10,15-pentaazabicyclo [5.5.5]heptadecane Manganese(II) Hexafluorophosphate Chloro-5,12,17-trimethyl-1,5,8,12,17-pentaazabicyclo [6.6.5]nonadecane Manganese(II) Chloride Chloro-4,10,15-trimethyl-1,4,7,10,15-pentaazabicyclo [5.5.5]heptadecane Manganese(II) Chloride Dichloro 5,12,15,16-tetramethyl-1,5,8,12-tetraazabicyclo [6.6.2]hexadecane Manganese(II)

Chloro 5-methyl-12-(2'-oxybenzyl)-1,5,8,12-tetraazabicyclo[6.6.2]hexadecane Manganese(II)

Preferred complexes useful as transition-metal bleach catalysts more generally include not only monometallic, mononuclear kinds such as those illustrated hereinabove but also bimetallic, trimetallic or cluster kinds. Monometallic, mononuclear complexes are preferred. As defined herein, a monometallic transition-metal bleach catalyst contains only one transition metal atom per mole of complex. A monometallic, mononuclear complex is one in which any donor atoms of the essential macrocyclic ligand are bonded to the same transition metal atom, that is, the essential ligand does not "bridge" across two or more transition-metal atoms.

Stabilization Agents

Anti-oxidants

One type of preferred stabilization agent according to the present invention are anti-oxidants. The compositions of the present invention will comprise an effective amount of the anti-oxidant, preferably from about 0.01%, more preferably from about 0.1%, most preferably from about 0.2% to about 10%, preferably to about 5%, more preferably to about 1% by weight of an anti-oxidant. Preferably the anti-oxidant is a free radical scavenger.

One class of anti-oxidants suitable for use in the present invention are the alkylated phenols having the general formula:

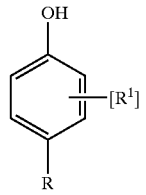

wherein R is $C_1$–$C_{22}$ linear or branched alkyl, preferably methyl or branched $C_3$–$C_6$ alkyl; $C_3$–$C_6$ alkoxy, preferably methoxy; $R^1$ is a $C_3$–$C_6$ branched alkyl, preferably tert-butyl; x is 1 or 2.

Another class of anti-oxidants suitable for use in the present invention are benzofuran derivatives having the formula:

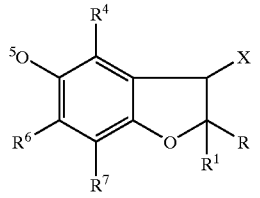

wherein $R^1$ and $R^2$ are each independently $C_1$–$C_4$ alkyl or $R^1$ and $R^2$ can be taken together to form a $C_5$–$C_6$ cyclic hydrocarbyl moiety; $R^4$ is $C_1$–$C_6$ alkyl; $R^5$ is hydrogen or —C(O)$R^3$ wherein $R^3$ is hydrogen or $C_1$–$C_{19}$ alkyl; $R^6$ is $C_1$–$C_6$ alkyl; $R^7$ is hydrogen or $C_1$–$C_6$ alkyl; X is —$CH_2OH$, or —$CH_2A$ wherein A is a nitrogen comprising unit, phenyl, or substituted phenyl. Preferred nitrogen comprising A units include amino, pyrrolidino, piperidino, morpholino, piperazino, and mixtures thereof. Non-limiting examples of anti-oxidants suitable for use in the present invention include phenols inter alia 2,6-tert-butylphenol, 2,6-di-tert-butyl-4-methylphenol, mixtures of 2 and 3-tert-butyl 1–4-methoxyphenol, and other ingredients including include propyl gallate, terbutyldroquinone, benzoic acid derivatives such as methoxy benzoic acid, methylbenzoic acid dichloro benzoic acid, dimethyl benzoic acid, 5-hydroxy-2,2,4,6,7-pentamethyl-2,3-dihydro-1-benzofuran-3-one, 5-hydroxy-3-methylene-2,2,4,6,7-pentamethyl-2,3-dihydro-benzofuran, 5-benzyloxy-3-hydroxymethyl-2,2,4,6,7-pentamethyl-2,3-dihydro-1-benzofuran, 3-hydroxymethyl-5-methoxy-2,2,4,6,7-pentamethyl-2,3-dihydro-1-benzofuran.

Reducing Agents

One type of preferred stabilization agent according to the present invention are reducing agents. The compositions of the present invention will comprise an effective amount of one or more reducing agents, preferably from about 0.001%, more preferably from about 0.01%, most preferably from about 0.02% to about 1%, preferably to about 0.5%, more preferably to about 0.1% by weight of a reducing agent. Preferably the reducing agent is an inorganic compound.

Non-limiting examples of reducing agents include compounds capable of yielding sulfite ions such as sodium sulfite, potassium sulfite, ammonium sulfite, sodium hydrogen sulfite, sodium metabisulfite, potassium metabisulfite, potassium hydrogen sulfite, pyrosulphite salts, sodium borohydride, lithium borohydride, lithium aluminum isopropoxide, and mixtures thereof.

Method of Use

The present invention further relates to a method for using stabilized bleach catalysts without the requirement of a peroxygen source of peroxygen to clean soil from and stains from fabric.

The present invention, therefore, relates to a method for bleaching soils and stains on fabric in the absence of a bleaching agent, said method comprising the step of contacting fabric in need of cleaning with an aqueous or non-aqueous solution containing a composition which is substantially free of a peroxygen source, comprising:

a) a catalytically effective amount of a transition-metal bleach catalyst which is a complex of a transition-metal and a cross-bridged macropolycyclic ligand;

b) an effective amount of a stabilizing agent, said agent selected from
   i) one or more anti-oxidants;
   ii) one or more reducing agents;
   iii) and mixtures thereof; and c) the balance carriers and other adjunct ingredients;

provided the concentration of said transition metal bleach catalyst in the solution is at least about 0.01 ppb and said composition is substantially free of any organic or inorganic peroxygen compounds.

Preferably the solution which comprises the transition-metal bleach catalyst has a solution concentration of catalyst of from about 1 ppb, more preferably from about 10 ppb, yet more preferably from about 100 ppb. For example, 100 ppb (parts per billion) is a solution which comprises 0.00001% by weight, of a catalyst. As defined herein above, solutions which comprises less than 0.001% of a source of peroxygen are solutions which are "substantially free" of any organic or inorganic peroxygen compounds.

Methods directed entirely to large scale bleaching per se, for example, an industrial or manufacturing process, may utilized a higher concentration of catalyst, for example, 1 ppm or higher in order to reduce the contact time of the fabric with the catalyst containing solution.

Adjunct Ingredients

The bleaching, pre-soak, pre-treatment, laundry or automatic dishwashing, or hard surface cleaning compositions of the present invention, whether granular, solid (bar), gel, or liquid may further comprise one or more carriers and adjunct ingredients.

Compositions according to the present invention may comprise:

a) a catalytically effective amount of a transition-metal bleach catalyst which is a complex of a transition-metal and a cross-bridged macropolycyclic ligand; and b) optionally from about 0.001% to about 90% by weight, of one or more dye fixing agents;

c) optionally from about 0.01% to about 50% by weight, of one or more cellulose reactive dye fixing agents;

d) optionally from about 0.01% to about 15% by weight, of a chlorine scavenger;

e) optionally about 0.005% to about 1% by weight, of one or more crystal growth inhibitors;

f) optionally from about 0.01% to about 20% by weight, of a fabric abrasion reducing polymer;

g) optionally from about 1% to about 12% by weight, of one or more liquid carriers;

h) optionally from about 0.001% to about 1% by weight, of an enzyme;

i) optionally from about 0.01% to about 8% by weight, of a polyolefin emulsion or suspension;

j) optionally from about 0.01% to about 0.2% by weight, of a stabilizer;

k) optionally from about 1% to about 80% by weight, of a fabric softening active;

l) optionally less than about 15% by weight, of a principal solvent; and m) optionally from about 0.01%, preferably from about 0.1%, to about 60%, preferably to about 30% by weight, one or more surfactants, said surfactants selected from the group consisting of anionic, cationic, nonionic, ampholytic, zwitterionic surfactants, and mixtures thereof.

Surfactants

The bleaching, pre-soak, pre-treatment, and laundry detergent compositions of the present invention may comprise at least about 0.01% by weight, preferably from about 0.1% to about 60%, preferably to about 30% by weight, of a detersive surfactant system, said system is comprised of one or more category of surfactants depending upon the embodiment, said categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

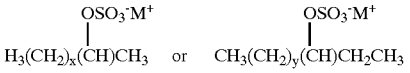

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24,1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates ($AEX_S$) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

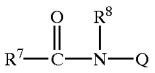

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_nCH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

The bleaching, pre-soak, pre-treatment, and laundry detergent compositions of the present invention can also comprise from about 0.001% to about 100% of one or more (preferably a mixture of two or more) mid-chain branched surfactants, preferably mid-chain branched alkyl alkoxy alcohols having the formula:

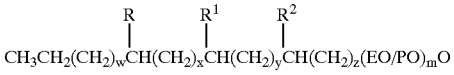

mid-chain branched alkyl sulfates having the formula:

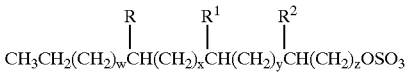

and mid-chain branched alkyl alkoxy sulfates having the formula:

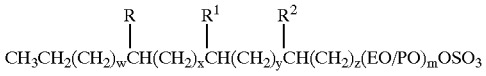

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethyleneoxy units and propyleneoxy units having the formula:

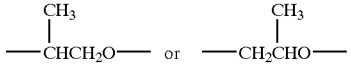

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

$$CH_3(CH_2)_aCH(CH_3)(CH_2)_bCH_2(EO/PO)_mOSO_3$$

or the formula:

$$CH_3(CH_2)_dCH(CH_3)(CH_2)_eCHCH_2(EO/PO)_mOSO_3$$

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) mid-chain branched alkyl arylsulfonate surfactants, preferably surfactants wherein the aryl unit is a benzene ring having the formula:

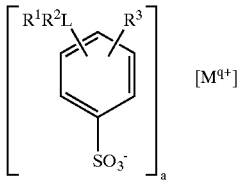

wherein L is an acyclic hydrocarbyl moiety comprising from 6 to 18 carbon atoms; $R^1$, $R^2$, and $R^3$ are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality.

Builders

The compositions of the present invention, especially when comprising surfactants, preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates described in U.S. Pat. No. 4,664,839 Rieck, issued May 12, 1987. NaSKS-6 is the trademark for a crystalline layered silicate marketed by Hoechst (commonly abbreviated herein as "SKS-6").

Examples of carbonate builders are the alkaline earth and alkali metal carbonates as disclosed in German Patent Application No. 2,321,001 published on Nov. 15, 1973.

Aluminosilicate builders are useful in the present invention. Examples of suitable aluminosilicate builders are described in U.S. Pat. No. 4,274,975 Corkhill et al. included herein by reference. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y]xH_2O$$

wherein z and y are integers of at least 6, the molar ratio of z to y is in the range from 1.0 to about 0.5, and x is an integer from about 15 to about 264. Preferred synthetic crystalline aluminosilicate ion exchange materials useful herein are available under the designations Zeolite A, Zeolite P (B), Zeolite MAP and Zeolite X.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Suitable are disclosed in U.S. Pat. No. 3,128,287 Berg, issued Apr. 7, 1964, U.S. Pat. No. 3,635,830 Lamberti et al., issued Jan. 18, 1972, U.S. Pat. No. 4,663,071 Bush et al., issued May 5, 1987, U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; U.S. Pat. No. 4,566,984, Bush, issued Jan. 28, 1986, U.S. Pat. No. 4,144,226, Crutchfield et al., issued March 13, 1979 and in U.S. Pat. No. 3,308,067, Diehl, issued Mar. 7, 1967, Diehl U.S. Pat. No. 3,723,322, and U.S. Pat. No. 4,102,903 Crutchfield et al., issued Jul. 25, 1978 and further U.S. Pat. Nos. 3,159,581; 3,213,030; 3,422,021; 3,400,148 and 3,422,137.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111, 984 Gosselink, published Jun. 27, 1984; European Patent Application 112,592 Gosselink, published Jul. 4,1984; U.S. Pat. No. 30 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4,1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N. V., 1974; all incorporated herein by reference.

Enzymes

The detergent and cleaning compositions herein may also optionally contain one or more types of detergent enzymes. Such enzymes can include other proteases, amylases, cellulases and lipases. Such materials are known in the art and are commercially available under such trademarks as. They may be incorporated into the non-aqueous liquid detergent compositions herein in the form of suspensions, "marumes" or "prills". Another suitable type of enzyme comprises those in the form of slurries of enzymes in nonionic surfactants, e.g., the enzymes marketed by Novo Nordisk under the tradename "SL" or the microencapsulated enzymes marketed by Novo Nordisk under the tradename "LDP." Suitable enzymes and levels of use are described in U.S. Pat. Nos. 5,576,282, 5,705,464 and 5,710,115.

Enzymes added to the compositions herein in the form of conventional enzyme prills are especially preferred for use herein. Such prills will generally range in size from about 100 to 1,000 microns, more preferably from about 200 to 800 microns and will be suspended throughout the non-aqueous liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

However, enzymes added to the compositions herein may be in the form of granulates, preferably T-granulates.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred for automatic dishwashing are amylases and/or proteases, including both current commercially available types and improved types which, though more and more bleach compatible though successive improvements, have a remaining degree of bleach deactivation susceptibility.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and known amylases, or mixtures thereof.

Examples of such suitable enzymes are disclosed in U.S. Pat. Nos. 5,705,464, 5,710,115, 5,576,282, 5,728,671 and 5,707,950

The cellulases useful in the present invention include both bacterial or fungal cellulases. Preferably, they will have a pH optimum of between 5 and 12 and a specific activity above 50 CEVU/mg (Cellulose Viscosity Unit). Suitable cellulases are disclosed in U.S. Pat. No. 4,435,307, J61078384 and WO96/02653 which discloses fungal cellulase produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50 KDa, an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in WO 91/17243. Also suitable cellulases are the EGIII cellulases from Trichoderma longibrachiatum described in WO94/21801 to Genencor. Especially suitable cellulases are the cellulases having color care benefits. Examples of such cellulases are cellulases described in European patent application No. 91202879.2, filed Nov. 6, 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Cellulases, when present, are normally incorporated in the cleaning composition at levels from 0.0001% to 2% of pure enzyme by weight of the cleaning composition.

Other preferred enzymes that can be included in the cleaning compositions of the present invention include lipases. Suitable lipase enzymes for detergent usage include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescent* IAM 1057. This lipase is available from Amano Pharmaceutical Co. Ltd., Nagoya, Japan, under the trade name Lipase P "Amano," hereinafter referred to as "Amano-P". Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* Especially suitable lipases are lipases such as M1 Lipase$^{R}$ *and* Lipomax$^{R}$ (Gist-Brocades) and Lipolase$^{R}$ and Lipolase Ultra$^{R}$(Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to cleaning compositions have been described in e.g. WO-A-88/09367 (Genencor); WO 90/09446 (Plant Genetic System) and WO 94/14963 and WO 94/14964 (Unilever).

Lipases and/or cutinases, when present, are normally incorporated in the cleaning composition at levels from 0.0001% to 2% of pure enzyme by weight of the cleaning composition.

In addition to the above referenced lipases, phospholipases may be incorporated into the cleaning compositions of the present invention. Nonlimiting examples of suitable phospholipases included: EC 3.1.1.32 Phospholipase A1; EC 3.1.1.4 Phospholipase A2; EC 3.1.1.5 Lysopholipase; EC 3.1.4.3 Phospholipase C; EC 3.1.4.4. Phospolipase D. Commercially available phospholipases include LECITASE® from Novo Nordisk A/S of Denmark and Phospholipase A2 from Sigma. When phospolipases are included in the compositions of the present invention, it is preferred that amylases are also included. Without desiring to be bound by theory, it is believed that the combined action of the phospholipase and amylase provide substantive stain removal, especially on greasy/oily, starchy and highly colored stains and soils. Preferably, the phospholipase and amylase, when present, are incorporated into the compositions of the present invention at a pure enzyme weight ratio between 4500:1 and 1:5, more preferably between 50:1 and 1:1.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is the protease called herein "Protease C", which is a variant of an alkaline serine protease from Bacillus in which Lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase as described in U.S. Pat. No. 5,677,272, and WO95/10591. Also suitable is a carbonyl hydrolase variant of the protease described in WO95/10591, having an amino acid sequence derived by replacement of a plurality of amino acid residues replaced in the precursor enzyme corresponding to position +210 in combination with one or more of the following residues : +33, +62, +67, +76, +100, +101, +103, +104, +107, +128, +129, +130, +132, +135, +156, +158, +164, +166, +167, +170, +209, +215, +217, +218, and +222, where the numbered position corresponds to naturally-occurring subtilisin from *Bacillus amyloliquefaciens* or to equivalent amino acid residues in other carbonyl hydrolases or subtilisins, such as *Bacillus lentus* subtilisin (co-pending patent application U.S. Ser. No. 60/048,550, filed Jun. 04, 1997 and PCT International Application Serial No. PCT/IB98/00853).

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

Particularly useful proteases are described in PCT publications: WO 95/30010; WO 95/30011; and WO 95/29979. Suitable proteases are commercially available as ESPERASE®, ALCALASE®, DURAZYM®, SAVINASE®, EVERLASE® and KANNASE® all from Novo Nordisk A/S of Denmark, and as MAXATASE®, MAXACAL®, PROPERASE® and MAXAPEM® all from Genencor International (formerly Gist-Brocades of The Netherlands).

Such proteolytic enzymes, when present, are incorporated in the cleaning compositions of the present invention a level of from 0.0001% to 2%, preferably from 0.001% to 0.2%, more preferably from 0.005% to 0.1% pure enzyme by weight of the composition.

Amylases (α and/or β) can be included for removal of carbohydrate-based stains. WO94/02597 describes cleaning compositions which incorporate mutant amylases. See also WO95/10603. Other amylases known for use in cleaning compositions include both α- and β-amylases. α-Amylases are known in the art and include those disclosed in US Pat. no. 5,003,257; EP 252,666; WO/91/00353; FR 2,676,456; EP 285,123; EP 525,610; EP 368,341; and British Patent specification no. 1,296,839 (Novo). Other suitable amylases are stability-enhanced amylases described in WO94/18314 and WO96/05295, Genencor, and amylase variants having additional modification in the immediate parent available from Novo Nordisk A/S, disclosed in WO 95/10603. Also suitable are amylases described in EP 277 216.

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: cc-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other amylolytic enzymes with improved properties with respect to the activity level and the combination of thermostability and a higher activity level are described in WO95/35382.

Such amylolytic enzymes, when present, are incorporated in the cleaning compositions of the present invention a level of from 0.0001% to 2%, preferably from 0.00018% to 0.06%, more preferably from 0.00024% to 0.048% pure enzyme by weight of the composition.

The above-mentioned enzymes may be of any suitable origin, such as vegetable, animal, bacterial, fungal and yeast origin. Origin can further be mesophilic or extremophilic (psychrophilic, psychrotrophic, thermophilic, barophilic, alkalophilic, acidophilic, halophilic, etc.). Purified or non-purified forms of these enzymes may be used. Nowadays, it is common practice to modify wild-type enzymes via protein/genetic engineering techniques in order to optimize their performance efficiency in the laundry detergent and/or fabric care compositions of the invention. For example, the variants may be designed such that the compatibility of the enzyme to commonly encountered ingredients of such compositions is increased. Alternatively, the variant may be designed such that the optimal pH, bleach or chelant stability, catalytic activity and the like, of the enzyme variant is tailored to suit the particular cleaning application.

In particular, attention should be focused on amino acids sensitive to oxidation in the case of bleach stability and on surface charges for the surfactant compatibility. The isoelectric point of such enzymes may be modified by the substitution of some charged amino acids, e.g. an increase in isoelectric point may help to improve compatibility with anionic surfactants. The stability of the enzymes may be further enhanced by the creation of e.g. additional salt bridges and enforcing calcium binding sites to increase chelant stability.

These optional detersive enzymes, when present, are normally incorporated in the cleaning composition at levels from 0.0001% to 2% of pure enzyme by weight of the cleaning composition. The enzymes can be added as separate single ingredients (prills, granulates, stabilized liquids, etc . . . containing one enzyme) or as mixtures of two or more enzymes ( e.g. cogranulates ).

Other suitable detergent ingredients that can be added are enzyme oxidation scavengers. Examples of such enzyme oxidation scavengers are ethoxylated tetraethylene polyamines.

A range of enzyme materials and means for their incorporation into synthetic detergent compositions is also disclosed in WO 9307263 and WO 9307260 to Genencor International, WO 8908694, and U.S. Pat. No. 3,553,139, Jan. 5, 1971 to McCarty et al. Enzymes are further disclosed in U.S. Pat. Nos. 4,101,457, and in 4,507,219. Enzyme materials useful for liquid detergent formulations, and their incorporation into such formulations, are disclosed in U.S. Pat. No. 4,261,868.

Amylase enzymes are suitable for use in the compositions of the present invention. Amylase enzymes and variants used in the present invention include, but are not limited to, the amylase enzymes described in WO 95/26397 and in WO 96/23873 (Novo). These enzymes are incorporated into cleaning compositions at a level of from about 0.0001%, preferably from about 0.00018%, more preferably from about 0.00024%, most preferably from about 0.05% to about 0.1%, preferably to about 0.060%, more preferably to about 0.048% by weight of the cleaning compositions of pure enzyme.

The amylase variants are preferably selected from the group consisting of α-amylase variants.

Suitable α-amylase variants for use in the present invention include, but are not limited to the following α-amylases:

(i) α-amylase characterized by having a specific activity at least 25% higher than the specific activity of Termamyl® at a temperature range of 25° C. to 55° C. and at a pH value in the range of 8 to 10, measured by Phadebas® α-amylase activity assay and/or;

(ii) α-amylase according to (i) comprising the amino acid sequence shown in SEQ ID No. 1 or an α-amylase being at least 80% homologous with the amino acid sequence shown in SEQ ID No. 1 and/or;

(iii) α-amylase according to (i) comprising the amino acid sequence shown in SEQ ID No. 2 or an α-amylase being at least 80% homologous with the amino acid sequence shown in SEQ ID No. 2 and/or;

(iv) α-amylase according to (i) comprising the following amino acid sequence N-terminal: His-His-Asn-Gly-Thr-Asn-Gly-Thr-Met-Met-Gln-Tyr-Phe-Glu-Trp-Tyr-Leu-Pro-Asn-Asp (SEQ ID No. 3) or an α-amylase being at least 80% homologous with the amino acid sequence shown (SEQ ID No. 3) in the N-terminal and/or;

(v) α-amylase according to (i–iv) wherein the α-amylase is obtainable from an alkalophilic Bacillus species and/or;

(vi) α-amylase according to (v) wherein the amylase is obtainable from any of the strains NCIB 12289, NCIB 12512, NCIB 12513 and DSM 935 and/or;

(vii) α-amylase showing positive immunological cross-reactivity with antibodies raised against an α-amylase having an amino acid sequence corresponding respectively to SEQ ID No. 1, ID No. 2, or ID No. 3 and/or;

(viii) variant of a parent α-amylase, wherein the parent α-amylase (1) has one of the amino acid sequences shown in SEQ ID No. 1, ID No. 2, or ID No. 4, respectively, or (2) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequences, in which variants: (A) at least one amino acid residue of said parent α-amylase has been deleted; and/or (B) at least one amino acid residue of said parent a:-amylase has been replaced by a different amino acid residue; and/or (C) at least one amino acid residue has been inserted relative to said parent α-amylase; said variant having an α-amylase activity and exhibiting at least one of the following properties relative to said parent α-amylase: increased thermostability; increased stability towards oxidation; reduced Ca ion dependency; increased stability and/or α-amylolytic activity at neutral to relatively high pH values; increased α-amylolytic activity at relatively high temperature; and increase or decrease of the isoelectric point (pI) so as to better match the pI value for α-amylase variant to the pH of the medium.

A polypeptide is considered to be X % homologous to the parent amylase if a comparison of the respective amino acid sequences, performed via algorithms, such as the one described by Lipman and Pearson in Science 227, 1985, p. 1435, reveals an identity of X %.

In the context of the present invention, the term "obtainable from" is intended not only to indicate an amylase produced by a Bacillus strain but also an amylase encoded by a DNA sequence isolated from such a Bacillus strain and produced in a host organism transformed with the DNA sequence.

Enzyme Stabilizers

Enzymes for use in detergents can be stabilized by various techniques. Enzyme stabilization techniques are disclosed and exemplified in U.S. Pat. No. 3,600,319, EP 199,405 and EP 200,586. Enzyme stabilization systems are also described, for example, in U.S. Pat. No. 3,519,570. A useful Bacillus, sp. AC13 giving proteases, xylanases and cellulases, is described in WO 9401532. The enzymes employed herein can be stabilized by the presence of water-soluble sources of calcium and/or magnesium ions in the finished compositions which provide such ions to the enzymes. Suitable enzyme stabilizers and levels of use are described in U.S. Pat. Nos. 5,705,464, 5,710,115 and 5,576,282.

The following is a non-limiting example of the preparation of a bleach catalyst which effectively bleaches stains in the absence of a source of peroxygen.

EXAMPLE 1

Synthesis of 5,12-dimethyl-1,5,8,12-tetraaza-bicyclo [6.6.2]hexadecane manganese (II) chloride, having the formula

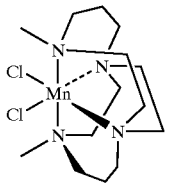

To a 250 mL, 3 necked round bottom flask, equipped with a thermometer, nitrogen inlet, and magnetic stirrer is added N,N'-bis(2-aminoethyl)-1,3-propanediamine (5.00 g, 31.3 mmol) and absolute ethanol (100 mL). The solution is stirred under argon and cooled to 15° C. using an ice bath. Aqueous glyoxal (4.78 g., 33 mmol, 40% in water) is added dropwise with stirring. Upon completion of the addition, the solution is concentrated under reduced pressure to yield a clear, colorless oil. The isolated oil has the formula 1:

1

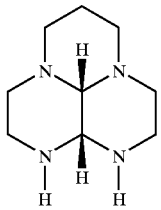

and is obtained in 100% yield (6.0 g).

Cyclic amine 1 (6.0 g) is suspended in acetonitrile (100 mL). Potassium carbonate (25 g) and 1,3-propanediol ditosylate (12.61 g, 32.8 mmol) is added. The solution is stirred vigorously at RT overnight. The reaction is then warmed to 70° C. and filtered hot with glass fiber filter paper and vacuum filtration. The resulting solid is washed with acetonitrile (100 mL). The acetonitrile filtrate is concentrated under reduced pressure to yield a light green oil having the formula 2:

2

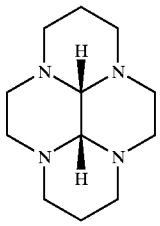

and is obtained in 100% yield (7.0 g).

The tetraamine 2, (7.0 g) is dissolved in acetonitrile (150 mL). Methyl sulfate (2.5 equiv.) is added, the reaction warmed to 65° C. and stirred for 9 days. The solvent is removed under reduced pressure to yield a brown oil having the formula 3:

3

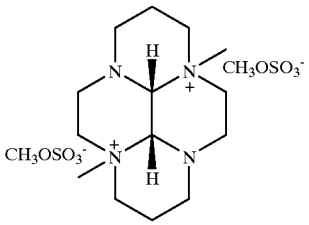

and is obtained in approximately 85% yield.

Distilled water (25 mL) and potassium carbonate (13.8 g) are added to a 250 mL round bottomed flask. Absolute ethanol (75 mL) is added and the resulting biphasic solution is stirred and heated to 60° C. with an oil bath. Sodium borohydride (1.60 g., 42.3 mmol) and 3 (10.0 g., 21.1 mmol) was added to the solution. The reaction is stirred at 60° C. for 75 minutes. The reaction mixture is placed in a separatory funnel and the ethanol layer collected. The solvent is then removed under reduced pressure, the resulting tan solid/oil is dissolved in 5N KOH (5 mL) and extracted with toluene (2×50 mL). The toluene is removed under reduced pressure to yield 5,12-dimethyl-1,5,8,12-tetraaza-bicyclo [6.6.2]hexadecane having the formula:

4

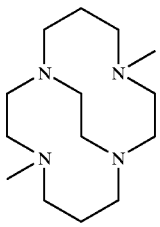

as an oil, in 95% yield (5.2 g) after distillation.

To a flame dried 12 liter, 3 neck round bottom flask equipped with a heating mantle, stir bar, and oven dried condenser is added anhydrous acetonitrile (5 liters) and yield 5,12-dimethyl-1,5,8,12-tetraaza-bicyclo[6.6.2]hexadecane (484 gm., 1.9 moles). The milky white suspension is placed under a 10 mm vacuum until the suspension boiled and then the reaction vessel flushed with argon. This degassing is performed 7 times. After degassing is complete manganese (II) chloride (228 gm, 1.81 moles) is added. After refluxing for 4 hours with vigorous stirring, the suspension is immediately filtered through glass filter paper. The solvent is removed from the filtrate under reduced pressure at 45° C. to yield a solid. The solid is then suspended in 500 ml. toluene, and the supernatant decanted off. This washing is repeated until the supernatant is free of color (typically 7 times with about 7×500 ml of toluene). The solid which remains I dried in vacuo to yield 575 g (84%) of 5,12-dimethyl-1,5,8,12-tetraaza-bicyclo[6.6.2]hexadecane magnanese (II) chloride. A second crop of product is obtained by further washing of the solid material and subsequent treatment of the resulting solid in a like manner. Total yield is 636 g (93%).

The following are non-limiting examples of Heavy Duty Liquid (HDL) laundry detergent compositions according to the present invention.

TABLE I

| Ingredients | weight % | | | |
|---|---|---|---|---|
| | 2 | 3 | 4 | 5 |
| $C_{14}$—$C_{15}$ alkyl E1.0 sulfate | 22.5 | 22.5 | 22.5 | 22.5 |
| Linear alkyl benzene sulfonate | 3.0 | 3.0 | 3.0 | 3.0 |
| $C_{10}$ amidopropyl DMA | 1.5 | 1.5 | 1.5 | 1.5 |
| $C_{12}$—$C_{14}$ alkyl E7.0 | 3.0 | 3.0 | 3.0 | 3.0 |
| Citric Acid | 2.5 | 2.5 | 2.5 | 2.5 |
| $C_{12}$—$C_{18}$ alkyl fatty acid | 3.5 | 3.5 | 3.5 | 3.5 |
| Rapeseed fatty acid | 5.0 | 5.0 | 5.0 | 5.0 |
| protease | 0.8 | 1.57 | 1.57 | 1.57 |
| amylase | 0.055 | 0.088 | 0.088 | 0.088 |
| cellulase | 0.188 | 0.055 | 0.055 | 0.055 |
| lipolase | 0.06 | — | — | — |
| mannanase | 0.007 | 0.0033 | 0.0033 | 0.0033 |
| Sodium metaborate | 2.0 | 2.5 | 2.5 | 2.5 |
| Ca formate/$CaCl_2$ | 0.02 | 0.10 | 0.10 | 0.10 |
| Bleach catalyst[1] | 0.035 | 0.034 | 0.034 | 0.034 |
| Anti-oxidant[2] | 0.23 | 0.25 | 0.25 | 0.25 |
| Reducing agent[3] | 0.02 | — | — | — |
| Reducing agent[4] | — | — | 0.0042 | 0.0083 |
| Hydrophobic dispersant[5] | 0.65 | 0.76 | 0.76 | 0.76 |
| Soil release agent[6] | 0.147 | — | — | — |
| Soil release agent[7] | — | 0.10 | 0.10 | 0.10 |
| Suds suppresser | 0.60 | 0.60 | 0.60 | 0.60 |
| Water and minors | balance | balance | balance | balance |

[1]5,12-dimethyl-1,5,8,12-tetraaza-bicyclo[6.6.2]hexadecane manganese (II) chloride.
[2]Butylated hydroxy toluene.
[3]Potassium metabisulfite.
[4]Potassium sulfite.
[5]PEI 189 E15-18 according to U.S. Pat. No. 4,597,898 Vander Meer, issued Jul. 1, 1986.
[6]Soil release agent according to U.S. Pat. No. 4,702,857 Gosselink, issued Oct. 27, 1987.
[7]Soil release agent according to U.S. Pat. No. 4,968,451, Scheibel et al., issued Nov. 6, 1990.

TABLE II

| Ingredients | weight % | | | |
|---|---|---|---|---|
| | 6 | 7 | 8 | 9 |
| $C_{14}$—$C_{15}$ alkyl E1.0 sulfate | 22.5 | 22.5 | — | — |
| $C_{12}$—$C_{15}$ alkyl E1.8 sulfate | — | — | 23.5 | 23.5 |
| Linear alkyl benzene sulfonate | 3.0 | 3.0 | 3.0 | 3.0 |
| $C_{10}$ amidopropyl DMA | 1.5 | 1.5 | — | — |
| $C_{12}$—$C_{14}$ alkyl E7.0 | 3.0 | 3.0 | 2.0 | 2.0 |
| Citric Acid | 2.5 | 2.5 | 2.5 | 2.5 |
| Sodium sulfate | — | — | 1.75 | 1.75 |
| $C_{12}$—$C_{18}$ alkyl fatty acid | 3.5 | 3.5 | 5.0 | 5.0 |
| Rapeseed fatty acid | 5.0 | 5.0 | 6.5 | 6.5 |
| protease | 1.57 | 1.57 | 1.57 | 1.57 |
| amylase | 0.088 | 0.088 | 0.088 | 0.088 |
| cellulase | 0.055 | 0.055 | 0.055 | 0.055 |
| mannanase | 0.0033 | 0.0033 | 0.0033 | 0.0033 |
| Sodium metaborate | 2.5 | 2.5 | 2.5 | 2.5 |
| Ca formate/$CaCl_2$ | 0.10 | 0.10 | 0.10 | 0.10 |
| Bleach catalyst[1] | 0.034 | 0.004 | 0.04 | 0.04 |
| Anti-oxidant[2] | 0.25 | 0.025 | 0.25 | 0.25 |
| Reducing agent[3] | — | — | 0.01 | — |
| Reducing agent[4] | 0.0083 | 0.001 | — | 0.01 |
| Hydrophobic dispersant[5] | 0.76 | 0.76 | 1.20 | 1.20 |
| Soil release agent[6] | — | — | — | — |
| Soil release agent[7] | 0.10 | 0.10 | 0.10 | 0.10 |
| Suds suppresser | 0.60 | 0.60 | 0.60 | 0.60 |
| Water and minors | balance | balance | balance | balance |

[1]5,12-dimethyl-1,5,8,12-tetraaza-bicyclo[6.6.2]hexadecane manganese (II) chloride.
[2]Butylated hydroxy toluene.
[3]Potassium metabisulfite.
[4]Potassium sulfite.
[5]PEI 189 E15-18 according to U.S. Pat. No. 4,597,898 Vander Meer, issued Jul. 1, 1986.
[6]Soil release agent according to U.S. Pat. No. 4,702,857 Gosselink, issued Oct. 27, 1987.
[7]Soil release agent according to U.S. Pat. No. 4,968,451, Scheibel et al., issued Nov. 6, 1990.

What is claimed is:

1. A bleaching composition comprising:

A) a catalytically effective amount of a transition-metal bleach catalyst which is a complex of a transition-metal and a cross-bridged macropolycyclic ligand;

B) an effective amount of a stabilizing agent, said agent selected from i) one or more anti-oxidants;

ii) one or more reducing agents;

iii) and mixtures thereof; and

C) the balance carriers and other adjunct ingredients;

provided said composition is substantially free of any organic or inorganic peroxygen compounds.

2. A composition according to claim 1 wherein said transition-metal bleach catalyst comprises:

i) a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(1ill), Cr(IV), Cr(V), Cr(VI), V(Ill), V(IV), V(V), Mo(IV), Mo(V), Mo(VI), W(IV), W(V), W(VI), Pd(II), Ru(II), Ru(III), and Ru(IV), and mixtures thereof; and ii) a cross-bridged macropolycyclic ligand being coordinated by four or five donor atoms to the same transition metal, said ligand comprising:

a) an organic macrocycle ring containing four or more donor atoms separated from each other by covalent linkages of 2 or 3 non-donor atoms, two to five of these donor atoms being coordinated to the same transition metal atom in the complex;

b) a cross-bridged chain which covalently connects at least 2 non-adjacent donor atoms of the organic macrocycle ring, said covalently connected non-adjacent donor atoms being bridgehead donor atoms which are coordinated to the same transition metal in the complex, and wherein said cross-bridged chain comprises from 2 to about 10 atoms;

iii) optionally, one or more non-macropolycyclic ligands.

3. A composition according to claim 2 wherein said organic macrocycle ring comprises at least four donor atoms which are N, said donor atoms separated from each other by covalent linkages of from 2 to 4 non-donor atoms, said donor atoms coordinated to the same transition metal atom.

4. A composition according to claim 3 wherein said cross-bridged chain comprises 2, 3 or 4 non-donor atoms.

5. A composition according to claim 2 wherein said donor atoms in the organic macrocycle ring of the cross-bridged macropolycyclic ligand are selected from the group consisting of nitrogen, oxygen, sulfur, phosphorous, and mixtures thereof.

6. A composition according to claim 2 comprising a transition-metal bleach catalyst wherein at least four of the donor atoms in the cross-bridged macropolycyclic ligand, form an apical bond angle with the same transition metal of 180±50° and at least one equatorial bond angle of 90±20°.

7. A composition according to claim 2 comprising a transition-metal bleach catalyst wherein two of the donor atoms in the cross-bridged macropolycyclic ligand occupy mutually trans positions of the coordination geometry, and at least two of the donor atoms in the cross-bridged macropolycyclic ligand occupy cis-equatorial positions of the coordination geometry.

8. A composition according to claim 1 which comprises at least about 1 ppb of a transition-metal bleach catalyst.

9. A composition according to claim 1 wherein said transition-metal bleach catalyst is 5,12-dimethyl-1,5,8,12-tetraaza-bicyclo [6.6.2]hexadecane manganese(II) chloride.

10. A composition according to claim 1, wherein said stabilizing agent is an anti-oxidant selected from the group consisting of 2,6-di-tert-butylphenol, 2,6-di-tert-butyl-4-methylphenol, mixtures of 2 and 3-tert-butyl-4-methoxyphenol, 5-hydroxy-2,2,4,6,7-pentamethyl-2,3-dihydro-1-benzofuran-3-one, 5-hydroxy-3-methylene-2,2,4,6,7-pentamethyl-2,3-dihydro-benzofuran, 5-benzyloxy-3-hydroxymethyl-2,2,4,6,7-pentamethyl-2,3-dihydro-1-benzofuran, 3-hydroxymethyl-5-methoxy-2,2,4,6,7-pentamethyl-2,3-dihydro-1-benzofuran, and mixtures thereof.

11. A composition according to claim 10 wherein said anti-oxidant is 2,6-di-tert-butylphenol, 2,6-di-tert-butyl-4-methylphenol, mixtures of 2 and 3-tert-butyl-4-methoxyphenol, and mixtures thereof.

12. A composition according to claim 1 wherein said composition comprises from about 0.0 1% to about 10% by weight of said anti-oxidant.

13. A composition according to claim 12 wherein said composition comprises from about 0.1% to about 5% by weight of said anti-oxidant.

14. A composition according to claim 1 wherein said stabilizing agent is an reducing agent selected from the group consisting of sodium sulfite, potassium sulfite, and mixtures thereof.

15. A composition according to claim 1 comprising from about 0.00 1% to about 1% by weight, of a reducing agent.

16. A composition according to claim 1 wherein said composition comprises at least one anti-oxidant stabilizing agent and at least one reducing agent stabilizing agent.

17. A liquid laundry, laundry pre-soak, or pre-treatment composition comprising:

a) a catalytically effective amount of a transition-metal bleach catalyst which is a complex of a transition-metal and a cross-bridged macropolycyclic ligand;

b) an effective amount of a stabilizing agent, said agent selected from i) one or more anti-oxidants;

ii) one or more reducing agents;

iii) and mixtures thereof; and c) the balance carriers and other adjunct ingredients;

provided said composition is substantially free of any organic or inorganic peroxygen compounds.

18. A composition according to claim 17 wherein said catalyst comprises:

i) a transition metal is selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), and;

ii) a cross-bridged macropolycyclic ligand, said ligand is selected from the group consisting of:

a) a cross-bridged macropolycyclic ligand of formula (I) having denticity of 4 or 5:

(I)

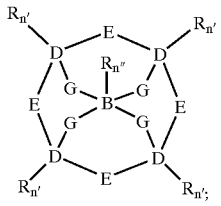

b) a cross-bridged macropolycyclic ligand of formula (II) having denticity of 5 or 6:

(II)

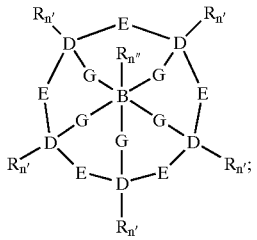

c) the cross-bridged macropolycyclic ligand of formula (III) having denticity of 6 or 7:

(III)

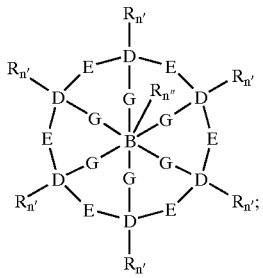

wherein each E unit represents the moiety having the formula:

$(CR_n)_a—X—(CR_n)_{a'}$ wherein X is selected from the group consisting of oxygen, sulfur, —NR—, phosphorous, or X represents a covalent bond wherein E has the formula:

$(CR_n)_a—(CR_n)_{a'}$ for each E units the sum of a+a' is independently selected from 1 to 5; each G unit is a moiety $(CR_n)_b$; each R unit is independently selected from H, alkyl, alkenyl, alkynyl, aryl, alkylaryl, and heteroaryl, or two or more R units are covalently bonded to form an aromatic, heteroaromatic, cycloalkyl, or heterocycloalkyl ring; each D unit is a donor atom independently selected from the group consisting of nitrogen, oxygen, sulfur, and phosphorous, and at least two atoms which comprise D units are bridgehead donor atoms coordinated to the transition metal; B units are a carbon atom, a D unit, or a cycloalkyl or heterocyclic ring; each n is an integer independently selected from 1 and 2, completing the valence of the carbon atoms to which the R units are covalently bonded; each n' is an integer independently selected from 0 and 1, completing the valence of the D donor atoms to which the R moieties are covalently bonded; each n" is an integer independently selected from 0, 1, and 2 completing the valence of the B atoms to which the R moieties are covalently bonded; each a and a' is an integer independently selected from 0 to 5, wherein the sum of all a+a' values in the ligand of formula (I) is within the range of from about 8 to about 12; the sum of all a+a' values in the ligand of formula (II) is within the range of from about 10 to about 15; and the sum of all a+a' values in the ligand of formula (III) is within the range of from about 12 to about 18; each b is an integer independently selected from 0 to 9, or in any of the above formulas, one or more of the $(CR_n)_b$ moieties covalently bonded from any D to the B atom is absent as long as at least two $(CR_n)_b$ covalently bond two of the D donor atoms to the B atom in the formula, and the sum of all b indices is within the range of from about 2 to about 5; and d) optionally, one or more non-macropolycyclic ligands.

19. A composition according to claim 18 wherein said catalyst comprises a non-macropolycyclic ligand selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors; wherein R is H, an alkyl moiety which is optionally substituted, or an aryl moiety which is optionally substituted.

20. A granular laundry, laundry pre-soak, or pre-treatment composition comprising:

a) a catalytically effective amount of a transition-metal bleach catalyst which is a complex of a transition-metal and a cross-bridged macropolycyclic ligand;

b) an effective amount of a stabilizing agent, said agent selected from i) one or more anti-oxidants;

ii) one or more reducing agents;

iii) and mixtures thereof; and c) the balance carriers and other adjunct ingredients;

provided said composition is substantially free of any organic or inorganic peroxygen compounds.

21. A method for bleaching soils and stains on fabrics, said method comprising the step of contacting fabric in need of cleaning with an aqueous or non-aqueous solution containing a composition comprising:

a) a catalytically effective amount of a transition-metal bleach catalyst which is a complex of a transition-metal and a cross-bridged macropolycyclic ligand;

b) an effective amount of a stabilizing agent, said agent selected from i) one or more anti-oxidants;

ii) one or more reducing agents;

iii) and mixtures thereof; and c) the balance carriers and other adjunct ingredients;

provided the concentration of said transition metal bleach catalyst in the solution is at least about 0.01 ppb and said composition is substantially free of any organic or inorganic peroxygen compounds.

22. A method according to claim 21 wherein said composition comprises an effective amount of 5,12-dimethyl-1,5,8,12-tetraazabicyclo[6.6.2] hexadecane manganese (II) chloride.

23. A method according to claim 21 wherein said solution contains less than 0.001% of an organic or inorganic peroxygen compound.

24. A method according to claim 23 wherein said composition comprises an effective amount of 5,1 2-dimethyl-1,5,8,1 2-tetraazabicyclo[6.6.21] hexadecane manganese (II) chloride.

25. A method according to claim 21 wherein said stabilizing agent is an anti-oxidant selected from the group consisting of 2,6-di-tert-butylphenol, 2,6-di-tert-butyl4-methylphenol, mixtures of 2 and 3-tert-butyl-4-methoxyphenol, 5-hydroxy-2,2,4,6,7-pentamethyl-2,3-dihydro-1-benzofuran-3-one, 5-hydroxy-3-methylene-2,2,4,6,7-pentamethyl-2,3-dihydro-benzofuran, 5-benzyloxy-3-hydroxymethyl-2,2,4,6,7-pentamethyl-2,3-dihydro-1-benzofuran, 3-hydroxymethyl-5-methoxy-2,2,4,6,7-pentamethyl-2,3-dihydro-1-benzofuran, and mixtures thereof.

26. A composition according to claim 25 wherein said anti-oxidant is 2,6-di-tert-butylphenol, 2,6-di-tert-butyl-4-methylphenol, mixtures of 2 and 3-tert-butyl-4-methoxyphenol, and mixtures thereof.

27. A composition according to claim 21 wherein said composition comprises from about 0.01% to about 10% by weight of said anti-oxidant.

28. A composition according to claim 27 wherein said composition comprises from about 0.1% to about 5% by weight of said anti-oxidant.

29. A composition according to claim 21 wherein said stabilizing agent is an reducing agent selected from the group consisting of sodium sulfite, potassium sulfite, and mixtures thereof.

30. A composition according to claim 21 comprising from about 0.00 1% to about 1% by weight, of a reducing agent.

31. A composition according to claim 21 wherein said composition comprises at least one anti-oxidant stabilizing agent and at least one reducing agent stabilizing agent.

32. A composition according to claim 2 wherein said transition metal bleach catalyst's transition metal is selected from the group consisting of Mn(II), Mn(III), Mn(IV), Fe(II), Fe(III), Fe(IV), Cr(II), Cr(II), Cr(IV), Cr(V), Cr(VI) and mixtures thereof.

33. A composition according to claim 2 wherein said transition metal bleach catalyst's optional, one or more non-macropolycyclic ligands are selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors; wherein R is H, optionally substituted alkyl, or optionally substituted aryl.

34. A composition according to claim 33 wherein said aromatic N donors are selected from the group consisting of pyridines, pyrazines, pyrazoles, imidazoles, benzimidazoles, pyrimidines, triazoles and thiazoles.

35. A composition according to claim 19 wherein said aromatic N donors are selected from the group consisting of pyridines, pyrazines, pyrazoles, imidazoles, benzimidazoles, pyrimidines, triazoles and thiazoles.

* * * * *